United States Patent [19]

Booth

[11] 3,982,608

[45] Sept. 28, 1976

[54] FIRE ESCAPE

[75] Inventor: Frederick Booth, New Westminster, Canada

[73] Assignee: Booth Fire Escape Ltd., New Westminster, Canada

[22] Filed: June 9, 1975

[21] Appl. No.: 585,311

[52] U.S. Cl. ..... 182/49; 182/81; 182/98

[51] Int. Cl.[2] ..... E06C 9/10

[58] Field of Search ..... 182/98, 97, 81, 86, 182/49, 48, 228, 194; 52/182

[56] References Cited

UNITED STATES PATENTS

| | | | |
|---|---|---|---|
| 333,624 | 1/1886 | Goodwillie | 182/86 |
| 882,499 | 3/1908 | Hull | 182/86 |
| 2,050,593 | 8/1936 | Traut | 182/98 |
| 3,015,373 | 1/1962 | McMillan | 52/182 |

FOREIGN PATENTS OR APPLICATIONS

| | | | |
|---|---|---|---|
| 109,541 | 7/1966 | Norway | 182/228 |
| 146,955 | 9/1954 | Sweden | 52/182 |
| 930,160 | 7/1963 | United Kingdom | 182/228 |

*Primary Examiner*—Reinaldo P. Machado
*Attorney, Agent, or Firm*—Carver and Company

[57] ABSTRACT

Fire escape apparatus having a flight of stairs formed of a smooth material having treads and risers and which is mounted beneath a balcony for swinging movement between a horizontal position and a downwardly inclined position, the treads and risers being so shaped that when the flight of stairs is in the inclined position, the treads slope inwardly and downwardly and the risers curve outwardly and downwardly to the treads so as to facilitate descent in a sitting position and to enable the stairs to be climbed in a normal manner.

4 Claims, 5 Drawing Figures

FIRE ESCAPE

BACKGROUND OF THE INVENTION

1. Field of the Invention

This invention relates to fire escapes, and in particular to fire escapes for buildings such as apartment buildings, the apartments of which have balconies spaced one above the other.

2. Prior Art

It has long been evident that in the event of fire in multiple storey buildings, exterior escape routes are preferrable in respect to safety than interior escape routes. Furthermore, exterior escape routes avoid the loss of valuable floor space taken up by interior routes.

Fire escapes on exterior walls of buildings usually take the form of a series of flights of stairs extending between landings disposed at every floor of the building, emergency exits being provided at every landing to permit escapees to avail themselves of the fire escape should the need arise. Present fire escapes of this type are usually bolted to the building and for obvious reasons are made as light as practically possible.

This type of fire escape is quite adequate to permit firemen to ascent to fight a fire, however, firemen find it difficult to evacuate a building as some escapees tend to freeze on the fire escape. It has been found, however, that those escapees who have a fear of heights can be pursuaded to descend a fire escape from great heights in a sitting position, that is to move from step to step in a sitting position. Furthermore, asthetically, fire escapes of this type leave much to be desired, consequently, they are not used in modern high-rise apartments where external appearance is considered to be of prime importance.

To this end, fire escapes offering little distraction to the aesthetic qualities of a building, have been devised to permit escape from balcony to balcony of apartments in apartment buildings. However, prior art escape devices of this type have proven costly to assemble and do not provide sifficient rigidity to assure a person who has a great fear of heights that the descent can be made in safety.

SUMMARY OF THE INVENTION

The present invention provides a fire escape device which is aminable for use in high-rise apartments as it detracts little from the appearance of the building, which is relatively inexpensive to fabricate and install, which is easy to descend in a sitting position and which has a great rigidity to lend assurance to a person who has a fear of heights that the descent can be made safely.

The fire escape of the present invention is adapted to be used in buildings having external balconies arranged one above the other and includes a frame having a pair of parallel spaced apart side supports which are pivotally secured at one end at the underside of an upper balcony for swinging movement between a horizontal position against the underside of the upper balcony to an inclined position resting on the balcony below, a strip of smooth material arranged to present a longitudinally extending series of concave curved portions secured along its side edges to the side supports, the curved portions being disposed so that when the frame is in its inclined position, said curved portions present a flight of stairs having downwardly and outwardly sloped risers and downwardly and inwardly sloped treads so as to facilitate descent of an escape in a sitting position.

The detailed description following, related to drawings, gives exemplification of preferred embodiments of the invention, which however is capable of expression in structure other than that described and illustrated.

DETAILED DESCRIPTION

Figure 1:
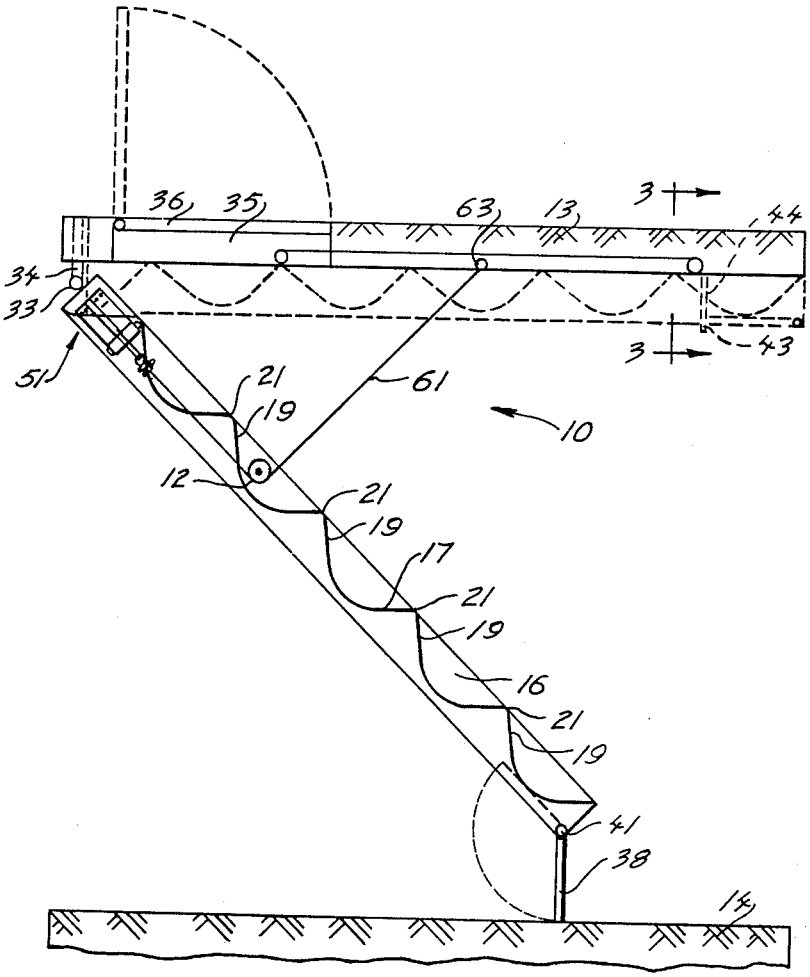
FIG. 1 is a side view, partially sectioned, of the fire escape of the invention shown in an inclined position in solid outline and in its stowed horizontal position in broken outline.
Figure 2:
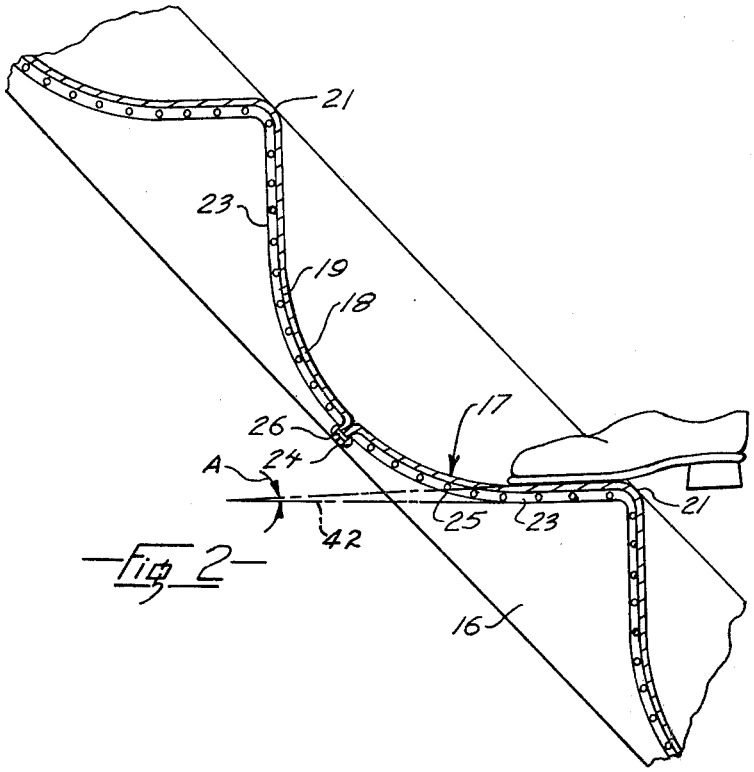
FIG. 2 is an enlarged central sectional view of a portion of the fire escape.
Figure 3:
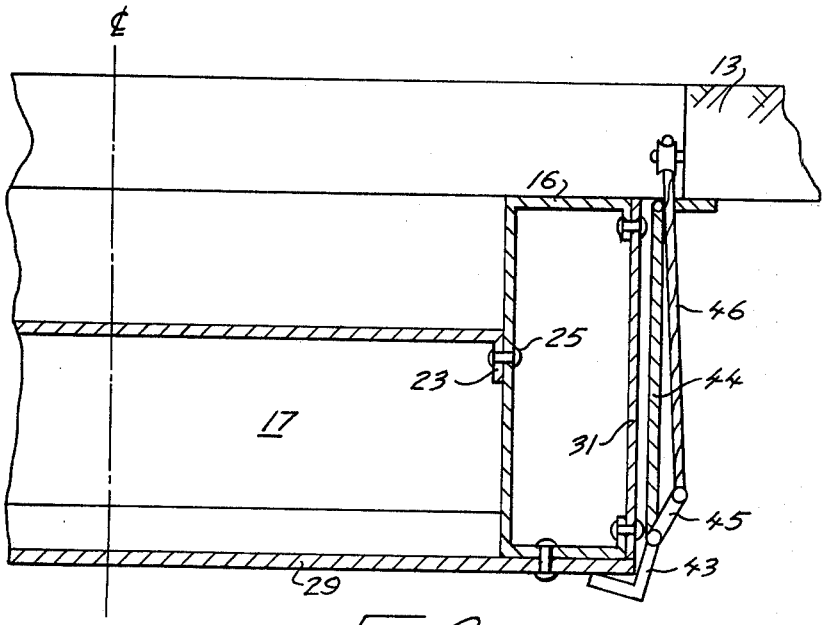
FIG. 3 is a half-section taken on Line 3—3 of FIG. 1 with the fire escape in its stowed horizontal position.

Referring to the drawings, FIGS. 1 through 3, the fire escape, generally 10, of the invention is shown secured to a building between a pair of balconies, the upper balcony being accorded numberal 13 and the lower balcony being accorded numberal 14. The device is swingably movable between an inclined position as shown in solid outline, and a stowed horizontal position as shown in broken outline in FIG. 1. The fire escape device has a frame formed of a pair of channel sectioned side supports 16—16 arranged in spaced side-by-side parallelism and opening outwardly away from each other. The side supports, for lightness, can be made of aluminum and are about eight inches in depth. Between the side supports extends a strip 17 of smooth material which can be made of a sheet of aluminum or other suitable light material.

As shown in FIGS. 1 and 2 the strip follows a somewhat zig-zag path between the side supports and is so formed that its upper surface 18 presents a series of long sweeping curved concave sections 19 and short radius convex crest portions 21.

As shown, particularly in FIG. 2, the strip of material 17 is longitudinally sectionalized substantially intermediately between adjacent crest portions and each section is so formed that it has downwardly turned side flanges, severally 23, and downwardly turned end flanges 24. The side flanges are secured by rivets 25 to the side supports and the end flange 24 of each section is secured by rivets 26 to the end flange of an adjacent section. The ajoining end flanges thus provide lower transverse braces while the short radius crest portion act as upper transverse braces so that the side supports remain in rigid parallelism even under heavy loads.

A bottom plate 29 extends the length of the frame and is secured by rivets to the underside of the side supports. Side plates 31 are also secured to the outer sides of the side supports so that from beneath the device has a smooth closed rectangular appearance.

The frame is swingably mounted at the upper end of the supports on a cross-shaft 33 which extends transversely between a pair of brackets 34 secured to the upper balcony at opposite sides of a manhole 35 therein. The manhole is normally closed by a trap door 36. A supporting leg 38 is swingably mounted on the cross-shaft 41 extending transversely between the supports at the lower ends thereof. The supporting leg, which is between two and three feet in length, can be swung from a stowed position, as shown in broken outline, in which it extends beneath and parallel to the side supports and a vertical position, as shown in solid outline, in which, with the frame in the inclined position, it rests on the lower balcony so as to support the lower ends of the side supports in an elevated position above the lower balcony.

As illustrated in FIGS. 1 and 2, curvature of the concave portions 19 of the strip 17 is such that with the device in its inclined position, the strip presents a flight of stairs having outwardly and downwardly curved risers and inwardly and downwardly sloped treads thus facilitating escapees to move in the descent in a sitting position, yet permitting a safe descent by firemen. Inward and downward slope of the treads form horizontal 42 is indicated by angle "A" in FIG. 2.

Spring operated latches 43–43 are pivotally mounted on the lower end of brackets 44–44 depending from the upper balcony adjacent and exteriorly of the side supports and near the free or lower ends of the latter. The latches have lever arms 45—45 to each of which a cable 46 is secured, the cable running upward to the manhole.

When the device is disposed in its stowed horizontal position, with the leg extending horizontally beneath the bottom plate, the latches extend beneath the leg and releasably retain the device in the stowed position. The device can, of course, be released from above by applying sufficient tension to the cables to swing the latches outwards and allow the device to swing downwards.

Figure 5:
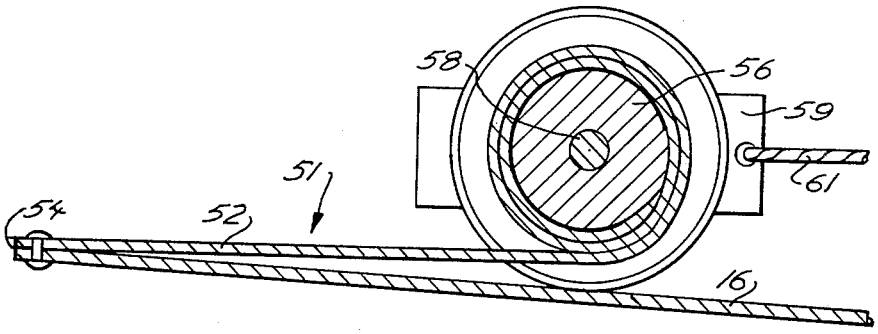
FIG. 5 is a sectional view taken on Line 5—5 of FIG. 4.
Figure 4:
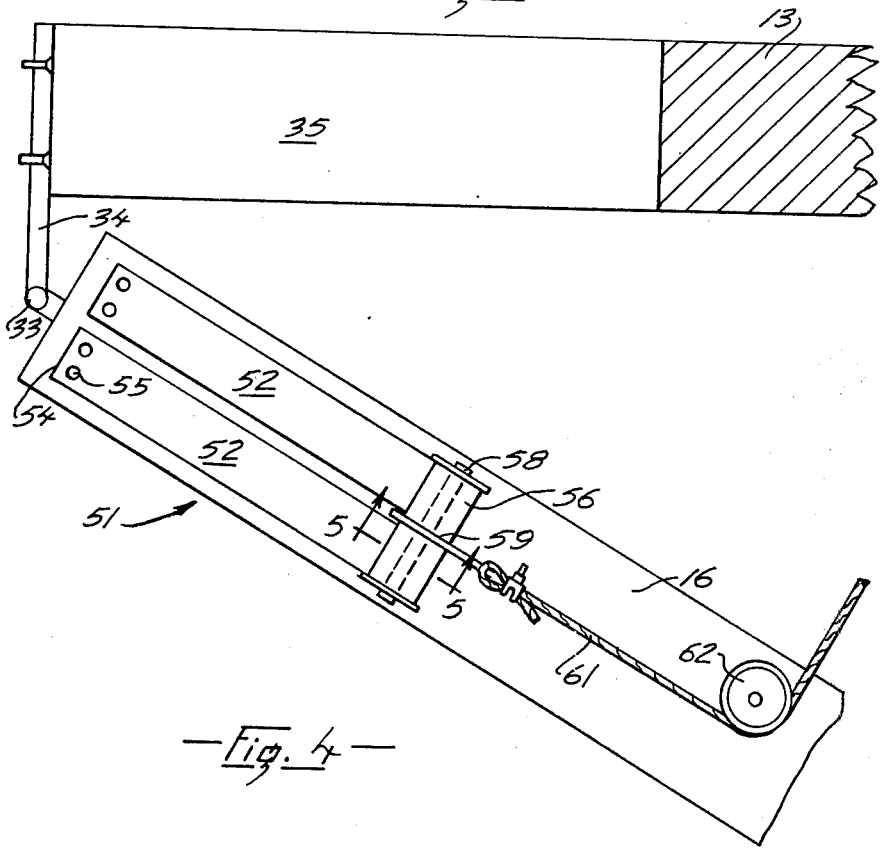
FIG. 4 is a side view of one end of the fire escape, portions removed showing a counter-balancing mechanism.

Controlled descent of the device from its stowed to its inclined position is effected by a spring operated counter-balance assembly 51 mounted on each of the supports, one being shown in FIGS. 1, 4 and 5. The assembly 51 has a pair of spring steel ribbons 52—52 which, in their state of repose, assume a coiled form. The ribbons are disposed in side-by-side relationship against the side support and are secured at free ends 54 by rivets 55 to the support. The ribbons are coiled on reels 56—56 which are mounted in side-by-side relationship on a common axle 58 and are spaced apart by a spacing bar 59 mounted on the axle. A cable 61 is secured to the spacer bar and extends towards the lower or free end of its associated support passing over a sheave 62 mounted on said side support and is secured at its upper end 63 to the upper balcony.

With the device in its stowed horizontal position, tendency of the ribbons to assume a coiled form, positions the reels at the secured ends of the springs. When the device swings downwards the reels, under the tension of the cable 61, move away from the secured ends of the springs thus extending the springs. Value of resilient restraint to uncoiling of the ribbons remains substantially constant between their coiled and extended positions so that tension on the cable 61 stays constant throughout movement of the frame between the stowed position to the inclined position. Counter-balancing effect of the assembly is arranged so that the frame, when released from its horizontal position, automatically swings to its inclined position, yet can with very little upward force be returned to its stowed position.

The flight of stairs is normally found in a stowed position beneath the upper balcony. In order to descend from the upper balcony, the trap door is swung away from the manhole and the stairs released by operation of the cable 46 so as to allow the frame to swing downward, at the same time the leg is released and swings to a vertical position and comes to rest on the lower balcony so as to support the device in the inclined position.

Fire escape devices as above described are located between adjacent balconies of a building so that descent can be made from balcony to balcony. The stairs when released from their stowed position will remain in the inclined position so as to enable fire fighters to ascend to any floor of the building.

I claim:

1. A fire escape apparatus for buildings having balconies arranged one above the other comprising:

a. a frame having a pair of parallel spaced side supports, b. means swingably mounting the frame at one end to an upper balcony for swinging movement between a horizontal position against the underside of the upper balcony and an inclined position resting on a lower balcony therebeneath, c. a strip of smooth material extending between and secured in the side edges to the side supports, said strip presenting a longitudinally extending series of sweeping upwardly concave portions and intervening crest portions, the curved portions being arranged so that with the frame in the inclined position the strip presents a set of stairs having downwardly and outwardly curved risers and inwardly and downwardly sloping treads, d. counter-balance means for yieldably resisting movement of the frame from its horizontal position to its inclined position.

2. A fire escape apparatus as claimed in claim 1 in which the strip of material is formed of a plurality of sections arranged in end-to-end relationship, each section adjoining an adjacent section substantially intermediately between the crest portions and in which each section has a downwardly turned flange at each end connected to the flange of the ajoining section so as to provide transverse braces substantially intermediately of the curved portions.

3. A fire escape apparatus as claimed in claim 1 in which the counter-balance means includes:

a. a spring steel ribbon normally assuming a coiled form in a state of repose having a free end secured to a side support, b. a reel on which the ribbon is wound, c. an axle rotatably supporting the reel, d. a cable connecting the axle and the upper balcony for moving the reel away from the free ends of the ribbon so as to extend the ribbon when the frame is moved from its stowed position to its inclined position.

4. A fire escape apparatus as claimed in claim 1 including latch means secured to an upper balcony for releasably locking the frame in its stowed position and means operable at the upper balcony for disengaging the latch means from the frame so as to enable the frame to swing from its stowed to its inclined position.

* * * * *